US006923269B2

(12) United States Patent
Berger et al.

(10) Patent No.: US 6,923,269 B2
(45) Date of Patent: Aug. 2, 2005

(54) DEMOLITION HAMMER AND/OR HAMMER-DRILL WITH A PERCUSSION DEVICE SUITABLE FOR RELEASING CLAMPED OBJECTS BY STRIKING

(75) Inventors: Rudolf Berger, Grünwald (DE); Wolfgang Schmid, München (DE); Mirko Lysek, München (DE); Thomas Schmidbauer, München (DE)

(73) Assignee: Wacker Construction Equipment AG, Munich (DE)

( * ) Notice: Subject to any disclaimer, the term of this patent is extended or adjusted under 35 U.S.C. 154(b) by 0 days.

(21) Appl. No.: 10/469,376

(22) PCT Filed: May 8, 2002

(86) PCT No.: PCT/EP02/05108

§ 371 (c)(1),
(2), (4) Date: Aug. 27, 2003

(87) PCT Pub. No.: WO02/092292

PCT Pub. Date: Nov. 21, 2002

(65) Prior Publication Data

US 2004/0108122 A1 Jun. 10, 2004

(30) Foreign Application Priority Data

May 14, 2001 (DE) ..... 101 23 397

(51) Int. Cl.[7] ..... B21J 7/02

(52) U.S. Cl. ..... 173/29; 173/48; 173/49; 173/90; 173/91; 173/2

(58) Field of Search ..... 173/29, 48, 49, 173/90, 91, 2, 4; 227/90, 91, 29, 48, 49, 201, 210, 212, 133; 254/29 R, 30

(56) References Cited

U.S. PATENT DOCUMENTS 1,202,551 A 10/1916 MacKenzie
3,356,166 A 12/1967 Diachenko
4,168,751 A * 9/1979 Deike ..... 173/133
4,548,279 A 10/1985 Zaruba
4,614,241 A * 9/1986 Crover ..... 173/211
5,431,235 A * 7/1995 Drumheller et al. ..... 173/211
5,921,327 A * 7/1999 Henriksson et al. ..... 173/210
5,944,118 A * 8/1999 Johansson et al. ..... 173/212
6,003,619 A 12/1999 Lange
6,298,923 B1 * 10/2001 Schmid et al. ..... 173/90

FOREIGN PATENT DOCUMENTS

DE 197 31 732 A1 2/1999

* cited by examiner

*Primary Examiner*—John Sipos
*Assistant Examiner*—Michelle Lopez
(74) *Attorney, Agent, or Firm*—Boyle Fredrickson Newholm Stein & Gratz S.C.

(57) ABSTRACT

The invention relates to a demolition hammer and/or hammer drill comprising a percussion generating device having a percussion piston moving axially back and forth. In a main percussion mode, the percussion piston impinges upon a tool which can move along a limited axial path straight into a main percussion direction. In a free percussion mode, the percussion piston indirectly impinges upon a percussion changing device, and by means thereof upon the tool, in a free percussion direction opposite to the main percussion direction. The impact surface of a tool shaft and the impact surface of a free percussion ram are placed opposite an impact surface of the percussion piston in such a way that the free percussion ram is removed from the effective area of the percussion piston by a return spring in the main percussion position. Under the effect of the return spring, the percussion ram is simultaneously supported on a gear member of the percussion changing device, which projects with an extension into the motion path of a stop surface provided in the tool. The stop surface reaches the extension when it has moved away from the effective area of the percussion piston in an idle running state of the tool shaft. If the movement of the tool is continued, the stop surface impinges upon the gear member against the effect of the return spring and relocates the free percussion ram in the effective area of the percussion piston by overcoming the spring force.

19 Claims, 4 Drawing Sheets

DEMOLITION HAMMER AND/OR HAMMER-DRILL WITH A PERCUSSION DEVICE SUITABLE FOR RELEASING CLAMPED OBJECTS BY STRIKING

BACKGROUND OF THE INVENTION

1. Field of the Invention

The invention relates to a demolition hammer and/or hammer drill in accordance with the preamble of claim 1.

2. Description of the Related Art

When working with demolition hammers and hammer drills it is frequently the case that the tool, e.g. a chisel or a drilling tool, becomes fixedly wedged or jammed in the rock. Whilst, after gaining some practice at drilling using the hammer drill, it is still possible in most cases to prevent the tool from becoming jammed, during demolition work using a large demolition hammer it is not always possible even for the person skilled in the art to prevent the chisel from becoming wedged or jammed.

This has been remedied by means of a percussion device which is disclosed in DE 197 31 732 A1. If the tool becomes jammed, the person operating the demolition hammer or hammer drill is able to switch on a free percussion device which serves to deflect the drive force, so that it influences the tool in the opposite direction to the main percussion direction, whereby—as tests have shown—the jammed tool can be released with a small number of impacts.

In the case of the known percussion device, a push lever is to be actuated on each occasion by the operator when the tool becomes jammed, whereby a percussion changing device can be activated. Furthermore, difficulties are to be expected in the sealing arrangement.

OBJECTS AND SUMMARY OF THE INVENTION

Therefore, it is the object of the invention to design a demolition hammer and/or hammer drill of the generic type such that it is possible—without any operating effort on the part of the operator—to switch in a simplified manner between the normal mode and the free percussion mode, wherein consideration is to be afforded to a principle, which is favourable in terms of strength, and to effective sealing capability.

In accordance with the invention the object is achieved by means of a demolition hammer and/or hammer drill in accordance with claim 1. Advantageous further developments of the invention are provided in the dependent claims.

In the case of the demolition hammer and/or hammer drill in accordance with the invention (also referred to hereinunder as a "hammer", a switch is made from the main percussion state to the free percussion state, if the demolition hammer and/or the hammer drill is pulled away from the material being worked when the tool becomes jammed. The hammer is pulled away intuitively by the operator, if he establishes that the tool has become jammed. As it is then the case that a switch is made to the free percussion state, the operator does not have to actuate any further devices, such as e.g. push-levers or the like which significantly reduces operational effort.

By pulling the hammer away from the rock being worked, a pulling force is generated in or on the tool which is detected by a force detection device and is changed respectively into a different physical variable such as e.g. a path. The force detection device cooperates with a switching device in such a manner that—if the pulling force exceeds a predetermined threshold value—the switching device performs a switch to the free percussion state. This means that the operator must pull on the hammer at least with a specific predetermined force, so that the switch is made to the free percussion state.

In an advantageous manner, the force detection device and the switching device form part of the percussion changing device. If the components of the percussion changing device can be used in this manner for several functions simultaneously, further components which are sensitive or susceptible to maintenance under certain circumstances become superfluous.

In the case of a particularly advantageous embodiment of the invention, the pulling force effective on the tool is proportional to an axial displacement of the tool relative to the rest of the hammer. This means that the force detection device is able to measure the pulling force by means of the axial displacement of the tool, e.g. against the effect of a spring. If the axial displacement of the tool exceeds a predetermined path, it is possible to conclude from this that the predetermined threshold value of the pulling force has also been exceeded. By detecting the axial displacement against the effect of a spring of the tool, it is not necessary to determine the pulling force which is actually effective on the tool. On the contrary, the axial displacement can be relayed via corresponding mechanisms directly to the switching device and can be used for the purpose of effecting a switch over to the free percussion state.

However, in the case of other embodiments of the invention the pulling force which is effective on the tool can also be determined by means of suitable force sensors, if there is no axial displacement of the tool relative to the rest of the hammer. The signals of the force sensors are then to be relayed in a suitable manner to the switching device.

In the case of a preferred embodiment of the invention, the percussion changing device comprises a first part, which in the free percussion state can be displaced into the effective region of the percussion piston, and comprises a second part which can be moved into positive-locking contact with a stop provided on the tool, wherein a movement of the tool can be transmitted via the second part to the first part of the percussion changing device, in order to move it into the effective region of the tool. As a consequence, the percussion changing device establishes an operative connection between the percussion piston and the stop on the tool, so that the percussion piston can influence the tool indirectly in the free percussion direction.

In the case of an advantageous embodiment, the percussion changing device comprises a free percussion ram, which can be moved into the effective region of the percussion piston of the percussive tool, and an extension which engages behind a collar of the tool. The percussion changing device is pretensioned by means of a spring in such a manner that in the main percussion state the free percussion ram is not located in the effective region of the percussion piston.

If in the free percussion state, i.e. when the tool is jammed, the demolition hammer and/or hammer drill is lifted from the material being worked, the collar of the tool presses against the extension, so that the percussion changing device and thus the free percussion ram are displaced against the effect of the return spring. As a consequence, the free percussion ram moves into the effective region of the percussion piston and can be influenced during a subsequent impact. The effect of the impact of the percussion piston is transmitted via the free percussion ram and the percussion changing device to the extension and thus ultimately to the collar of the tool in the free percussion direction, opposite the main percussion direction.

In so doing, it is particularly advantageous if the percussion piston influences the free percussion ram in the free percussion state in the main percussion direction as this serves to maintain the percussion direction of the percussion piston.

In the case of a preferred embodiment, the demolition hammer and/or hammer drill is subdivided into a drive unit and a tool unit which each comprise a housing and can be mutually coupled by mechanically connecting the housings, wherein the coupling region of the drive unit which is open with respect to the tool unit is provided with the impact surface of the percussion piston, opposite to which in the coupling region of the tool unit lie the impact surface of the tool shaft and the impact surface of the free percussion ram such that in the main percussion state the free percussion ram is removed by the return spring from the effective region of the percussion piston and at the same time is supported under the effect of this return spring on a gear member which is associated with the percussion changing device and which protrudes with an extension into the movement path of the stop surface provided on the tool, wherein the stop surface reaches the extension, if during an idle running state the tool shaft has been removed from the effective region of the percussion piston, so that as this movement of the tool continues the stop surface influences the gear member against the effect of the return spring and displaces the free percussion ram into the effective region of the percussion piston when this spring force is overcome.

As long as the hammer is pressed against the material being worked, the tool is consequently urged at the same time into the effective region of the percussion piston, whereas the return spring keeps the free percussion ram out of this effective region. If the hammer is pulled back, the tool slides out of the effective region of the percussion piston until it lies against the extension. The device is then located in the idle running state. If the tool becomes jammed and the device is pulled further back, the pulling force increases and moves the extension against the effect of the return spring and thereby urges the free percussion ram into the effective region of the percussion piston, so that the percussion piston then performs impacts via the extension on to the tool in the opposite direction to the main percussion direction. This state is called the free percussion state. As soon as the tool is released, the return spring re-establishes the original state and the device is then located in the idle running state, until it is pressed against the material once again.

The change between the operating states is performed automatically. A mechanical connection is provided between the drive unit and the tool unit merely by virtue of the connection of their housings on both sides. The impacts of the percussion piston on to the tool and, where appropriate, the necessary release impacts on to the free percussion ram and the switch between the various operating states do not require any additional connection between the two units. Upon release of the coupling connection, they can be separated quickly and conveniently from each other, maintained separately and put back together again as quickly and conveniently. It is possible to connect tool units, which are adapted to suit different tools, to the drive unit if the connection dimensions are respected only in the connection region and the impact surfaces of the tool and of the free percussion ram lie opposite the percussion piston. This means that there is extensive scope with regard to the respectively expedient design of the percussion changing device.

In a manner which is known per se, the stop is preferably a collar which widens the cross-section of the tool.

According to an advantageous embodiment, the gear member is a deflecting lever which is mounted on the housing in such a manner as to be able rotate about a first axle, wherein according to a further embodiment the gear member is allocated a blocking device which is suitable for limiting its angle of rotation between two limit positions such that the extension always protrudes into the path of the stop and the free percussion ram is located in the one limit position in the effective region of the percussion piston and is located in the other limit position just outside this effective region.

Preferably, the blocking device is a latching and unlatching lever which is mounted on the housing in such a manner as to be able to rotate about an axle, which is in parallel with the axle of rotation of the gear member and has a spaced interval therefrom, and can be fixed by means of a latch connection in a blocking and locking position in its angular position relative to the housing, that a spigot which is formed on the gear member engages into a connecting link which is provided on the latching and unlatching lever and which in the blocking and latching position of said lever limits the angle of rotation of the gear member between the two limit positions, whereas upon overcoming the latch connection the latching and unlatching lever can be pivoted into an unlatching position, in which the connecting link has pivoted the gear member to a position, in which the extension is located outside the movement path of the stop on the tool.

Another very expedient embodiment is one in which the unlatching lever consists of two limbs which are axially spaced apart from each other and are connected at their ends remote from the axle by means of a cross-piece and which, for mounting in the housing, are provided in each case with an axle stub on their mutually remote outer sides, and that the gear member engages into the intermediate space between the two limbs, whereas its axle is located outside the pivot region of the latching and unlatching lever.

BRIEF DESCRIPTION OF THE DRAWINGS

The invention will now be explained in detail with reference to the description hereinunder of a preferred exemplified embodiment of the invention as illustrated in the Figures, in which.

DETAILED DESCRIPTION OF THE PREFERRED EMBODIMENT

Figure 1C:
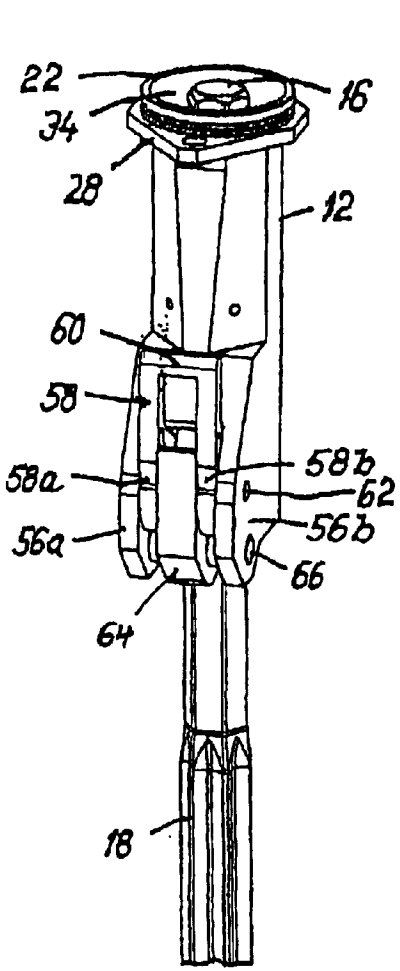
FIG. 1*c* shows a perspective view of the tool unit in the main percussion state.

The Figures all illustrate a section of an inventive demolition hammer and/or hammer drill in various states or views. Therefore, in order to explain the structure reference is made hereinunder to all Figures simultaneously.

The drawing illustrates only the tool unit, which is designated overall by the reference numeral 10, of a demolition hammer and/or hammer drill. The drive unit which contains a percussion generating device in a design which is known per se, e.g. a pneumatic spring percussive tool, has been omitted for the purpose of simplification. It contains e.g. a crank drive, which is driven by an electromotor, and a drive piston which can be moved in an axial direction by means of this crank drive and which can be moved axially in a hollow-cylindrical recess of a percussion piston. The percussion piston is disposed in an axially movable manner in a housing of the drive unit such that its end surface which serves to transmit force to the tool in a main percussion direction and is defined as the impact surface is located in the region of a housing orifice which faces the tool unit 10 which is to be connected to the drive unit. Where appropriate, it is also possible to dispose a riveting die, which serves as an intermediate element, between the percussion piston and the tool. Essentially all types of percussive tools are suitable for the application of the invention.

The operating states are distinguished as follows: A main percussion state, in which the hammer operates in a conventional manner, i.e. impacts are exerted upon a tool; an idle running state, in which the drive of the does continue to operate but no impacts are exerted on to the chisel by the percussion generating device; and a free percussion state, in which impacts are exerted on to the tool in a free percussion direction which is opposite to the main percussion direction, i.e. away from the material being worked.

The tool unit comprises a housing 12 which is penetrated by a central guide channel 14 for the shaft 16 of a tool 18, e.g. a chisel, which comprises a hexagonal cross-section. On its coupling end 20 which is allocated to the drive unit, the housing 12 is provided with a cylindrical projection 22 which contains on its outer side an annular groove 24 for the purpose of receiving a seal. This projection 22 can be inserted into an allocated receiving device on the housing of the drive unit [not illustrated]. A flange 28, which is provided with bores 26, on the housing 12 of the tool unit serves to connect the tool unit 10 and the drive unit in a mechanical manner. The connection can be established quickly and conveniently by means of two screws. Further measures are not required for the purpose of coupling the two units.

The tool 18 is provided with a collar 30, for the reception of which the guide channel 14 in the end portion of the housing 12 remote from the projection 22 is provided with a cross-sectional widening 32. The length of this is dimensioned in such a manner that the tool 18 is prevented from moving further in the direction of the projection 22 by virtue of the fact that the collar 30 lies against the end of the cross-sectional widening 32, if the shaft 16 in the region of the projection 22 protrudes out of the housing 12 to such an extent into the movement region of the percussion piston [not illustrated] that the percussion piston is able to transmit its percussion movement to the tool 18. This situation which is assumed in the main percussion state and is defined as the percussion position is illustrated in FIGS. 1*a* to 1*c*.

The end of the housing 12 facing the drive unit is provided with a trough-like recess 34, in the centre of which the guide channel 14 opens out. Adjacent to the guide channel 14, a guide channel 36 for a free percussion ram 38 opens out. This guide channel 36 approaches the guide channel 14 at an acute angle in the direction of the recess 34. In its guide portion 40 which opens out in the recess 34, the guide channel 36 surrounds the cylindrical free percussion ram 38 which in its end portion 42 remote from the recess 34 comprises an enlarged cross-section which serves to form a shoulder 44. Formed in the end portion 42 is a longitudinal slot 46 through which passes a pin 48 which is attached in the housing 12, whereby the free percussion ram 38 is prevented from rotating. The end of the free percussion ram 38 which is remote from the recess 34 comprises a contact surface 50 which extends in an inclined manner with respect to the axis of the ram and which is aligned approximately at a right angle with respect to the axis of a piston 52 which is guided in a movable manner in an axial direction in the housing 12 and which is part of a percussion changing device 54 which is disposed substantially between two mutually parallel flanges 56*a* and 56*b* which are disposed on the housing 12.

The percussion changing device 54 further comprises two congruent limbs 58*a* and 58*b* of a latching and unlatching lever 58 which are mutually connected by means of a cross-piece 60 at the free end of the lever. The limbs 58*a* and 58*b* are mounted in each case in a rotatable manner on one of the flanges 56*a* and 56*b* respectively by means of axle stubs 62 which are disposed in a coaxial manner with respect to each other. Disposed between the two limbs 58*a* and 58*b* is a gear member or curve piece 64 which serves as a deflecting lever and locking bar and which is mounted outside the pivot region, which is utilised by the latching and unlatching lever 58, by virtue of an axle 66 on the flanges 56*a* and 56*b* which is in parallel with the axle stubs 62. A spigot 68 which is connected to the curve piece 64 engages in connecting links 70 which are formed congruently on the limbs 58*a* and 58*b*. The curve piece 64 is also provided with an extension 72 which protrudes into the movement path of the collar 30 on the tool 18 in the percussion position illustrated in FIGS. 1*a* to 1*c*, wherein the collar 30 does not, however, reach as far as the extension 72 during the percussion mode of the tool 18.

Figure 1B:
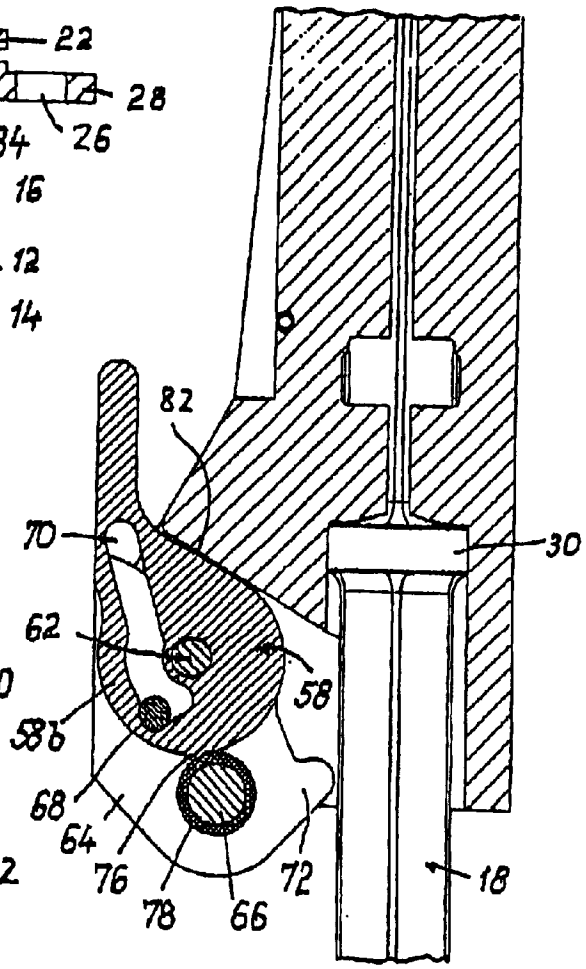
FIG. 1*b* shows a sectional view in parallel with the axial sectional view as shown in FIG. 1*a* and slightly offset with respect to the sectional view of FIG. 1*a* in the direction of the viewer.
Figure 1A:
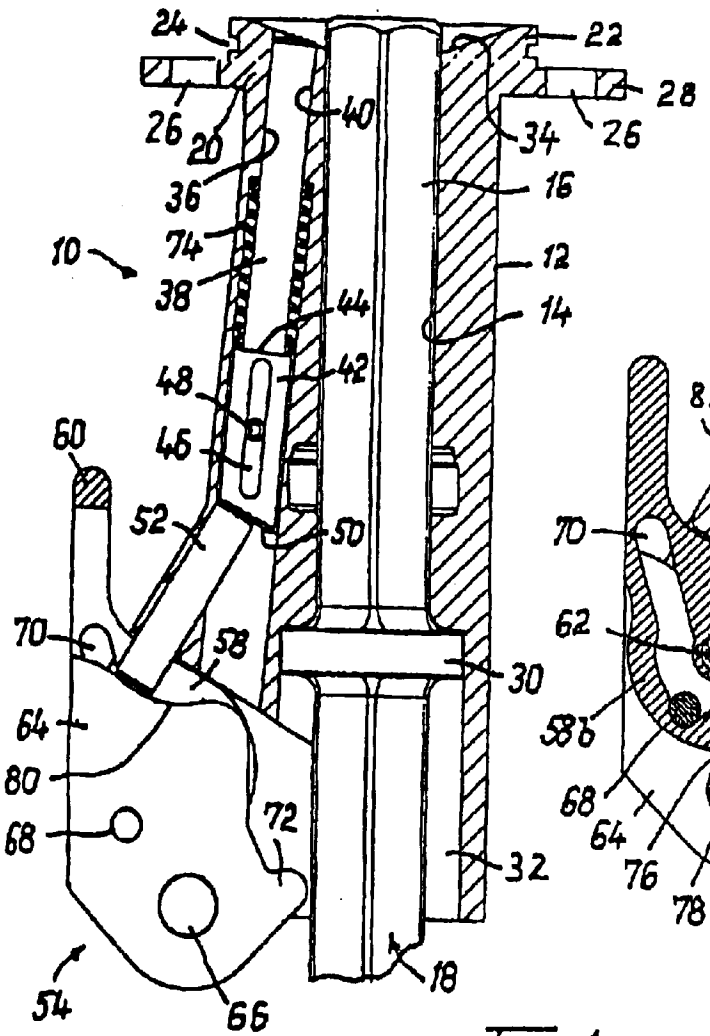
FIG. 1*a* shows an axial sectional view of the tool unit with the tool inserted in the percussion position (main percussion state)

Between the end of the guide portion 40, which is remote from the recess 34, and the shoulder 44, a helical compression spring 74 which serves as a return spring surrounds the free percussion ram 38 and draws the free percussion ram 38 out of the recess 34 and presses with its contact surface 50 against the piston 52 which for its part is supported on the curve piece 64 and transmits thereto a torque which in FIGS. 1*a* and 1*b* acts in an anti-clockwise direction and which serves to support the spigot 68 in the connecting links 70 and thus on the latching and unlatching lever 58. The latching and unlatching lever 58 is provided on its periphery with a cam-like projection 76 which lies against an elastic sleeve 78 which surrounds the axle 66. The resistance of this sleeve 78 is sufficient to fixedly hold the latching and unlatching lever 58 in the position shown in FIGS. 1*a* to 1*c*, whereby the curve piece 64 also retains its position and the extension 72 is held in the path of the collar 30.

The latching and unlatching lever 58 is additionally fixed by virtue of the fact that the effect of the helical compression spring 74 causes the piston 52 to be pressed against the curve piece 64. The curve piece 64 supports the spigot 68 and urges it to the position shown in FIG. 1*b* in the connecting link 70 against the latching and unlatching lever 58. By reason of the force which is introduced by the spigot 68 and is effective about the axle 66, a torque is generated about the axle stub 62 which presses the latching and unlatching lever 58 about the axle stub 62 to the position shown in FIG. 1*a* against a stop 82 to be explained hereinunder. Therefore, the helical compression spring 74 also indirectly causes the latching and unlatching lever 58 to be fixedly held in the position shown in FIGS. 1*a* to 1*c*.

In the percussion position as shown in FIGS. 1*a* to 1*c*, as achieved in the main percussion state, it is only the tool 18 which is influenced by the percussion piston.

Figure 2C:
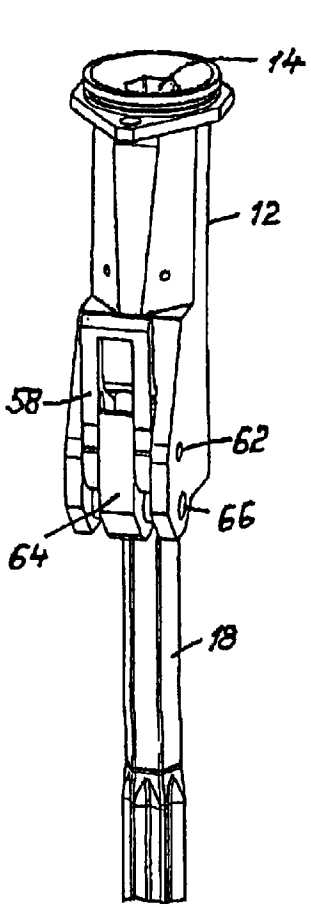
FIG. 2*c* shows a perspective view of the tool unit in the idle running state.
Figure 2B:
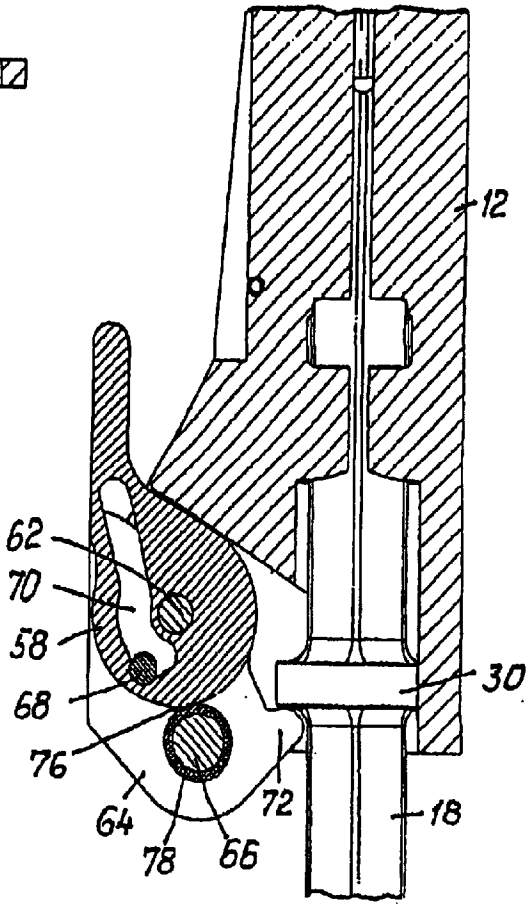
FIG. 2*b* shows an illustration, corresponding to FIG. 1*b*, of the idle running state.
Figure 2A:
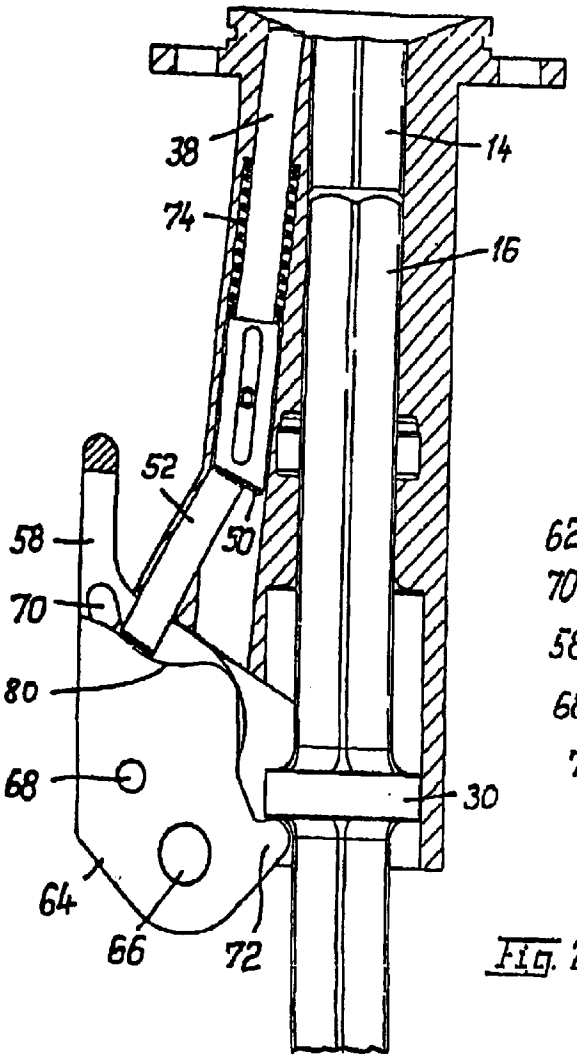
FIG. 2*a* shows an illustration, corresponding to FIG. 1*a*, of the idle running state.

If the pressure on the hammer is removed and the hammer is pulled back from the material being worked, when the device is held in the conventional manner with the tip of the tool pointing downwards the tool 18 will slide a certain length out of the housing 12 until the collar 30 is stopped by the extension 72. This is the idle running position as shown in FIGS. 2*a* to 2*c*, in which the tool 18 is not influenced by the percussion piston and the free percussion device also does not become effective.

Furthermore, in the idle running position it is possible for the percussive tool [not illustrated] to change over in a known manner to an idle running state, in which the percussion piston does not perform any impacts.

If, after achieving the idle running state, the operator pulls harder on the hammer and the tool has become jammed in the material being worked, the tool cannot take part in the withdrawal movement of the hammer. The pulling force exerted by the operator upon the device becomes effective at the extension 72 and seeks to pull the tool 18 at its collar 30 out of its jammed position. By reason of the resistance of the jammed tool 18, the force of the helical compression spring 74 is overcome. In the drawing, the curve piece 64 rotates in a clockwise direction, lifts the piston 52 and presses the free percussion ram 38 against the effect of the helical compression spring 74 into the movement region of the percussion piston, whereby the impacts thereof are deflected by the curve piece 64, which represents a two-armed lever, on the extension 72 in the opposite direction and, by way of the collar 30, the impacts influence the tool 18 in the opposite direction to the main percussion direction in a free percussion direction.

Depending upon the behaviour of the operator, it is possible to change directly from the main percussion state to the free percussion state or to change indirectly from the main percussion state via the idle running state to the free percussion state. If the operator quickly lifts the hammer from the rock being worked when the tool is jammed, there is no time for the percussive tool to change to the idle running state by the displacement of the percussion piston. On the contrary, from one stroke to another the percussion piston is not presented with the tool shaft 16 but rather with the free percussion ram 38, so that the percussion mode is continued (however at this time as the free percussion mode).

In contrast, if the operator slowly lifts the hammer from the rock being worked when the tool is jammed, the idle running state illustrated in FIGS. 2*a* to 2*c* is set, in which neither the tool shaft 16 nor the free percussion ram penetrates into the effective region of the percussion piston. Subsequently, the percussion piston slides so far forwards into the region of the recess 34 that the percussive tool [not illustrated] changes to the idle running state. As the hammer is pulled further with respect to the tool 18 which is jammed, the free percussion ram 38 pushes the percussion piston back into the percussive tool which serves then to start up the percussion mode but this time in the free percussion mode.

Figures 3A, 3B, 3C:
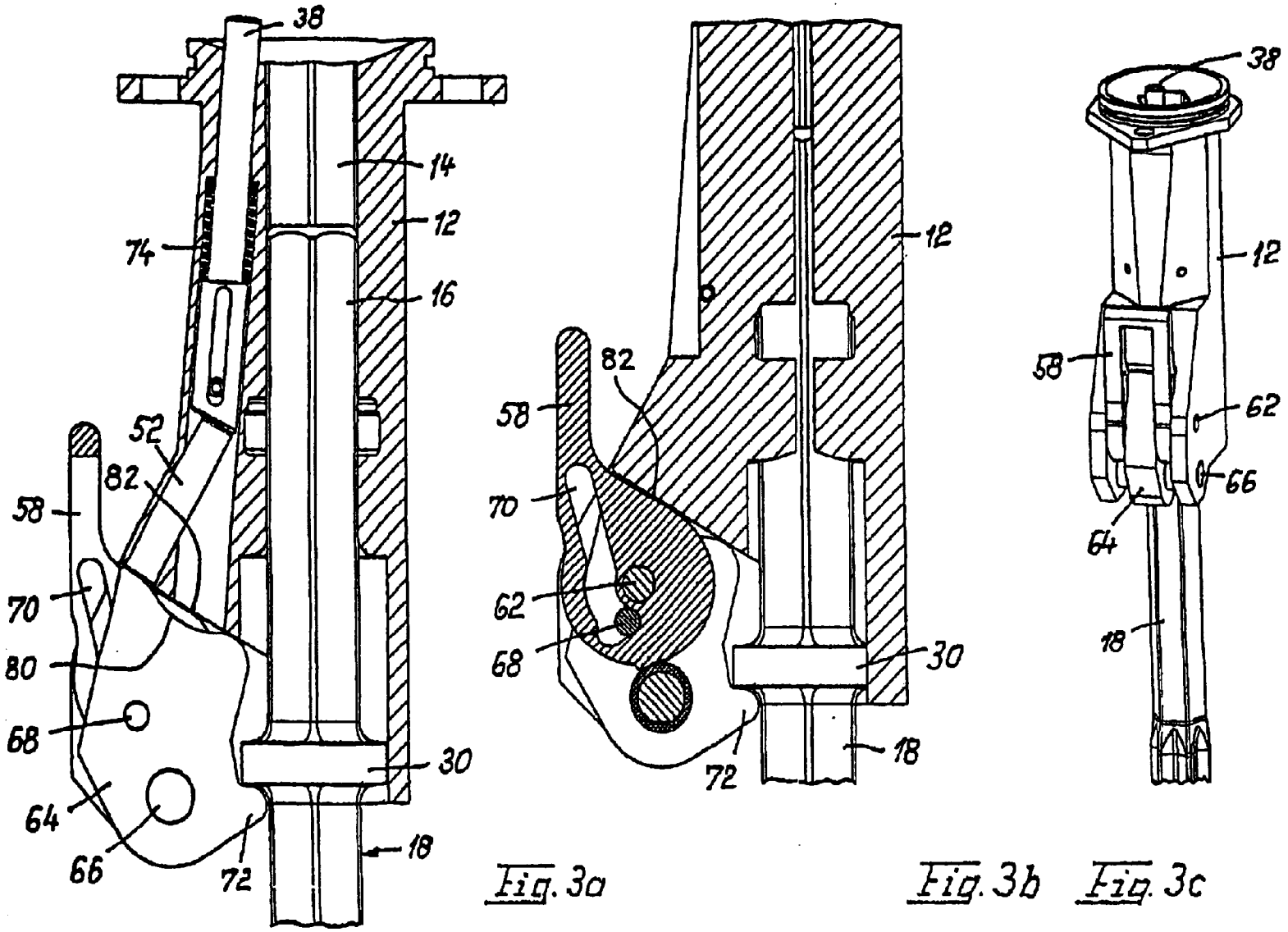
FIG. 3*a* shows an illustration, corresponding to FIG. 1*a*, in the free percussion position (free percussion state)
FIG. 3*b* shows an illustration, corresponding to FIG. 1*b*, in the free percussion position.
FIG. 3*c* shows a perspective view of the tool unit in the free percussion position.

This situation which is achieved in the free percussion state and is also defined as the free percussion position is illustrated in FIGS. 3*a* to 3*c*.

As soon as the tool 18 is released, the pulling force at the extension 72 diminishes and the helical compression spring 74 urges the free percussion ram 38 back out of the effective region of the percussion piston, so as to restore the idle running position as shown in FIGS. 2*a* to 2*c*.

Figures 4A, 4B, 4C:
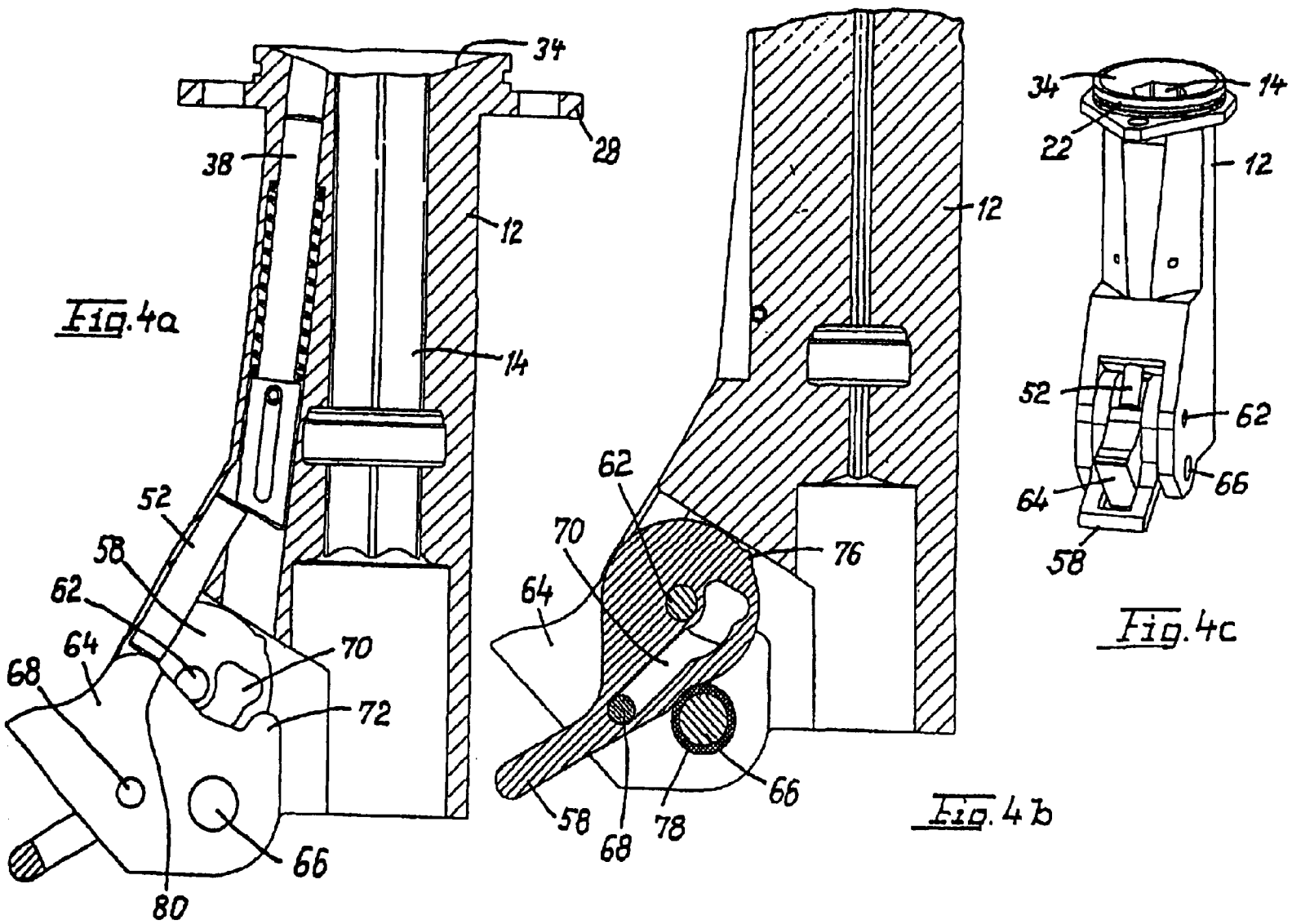
FIG. 4*a* shows an illustration, corresponding to FIG. 1*a*, in the open position with the tool removed.
FIG. 4*b* shows an illustration, corresponding to FIG. 1*b*, in the open position with the tool removed.
FIG. 4*c* shows a perspective view of the tool unit in an open position with the tool removed.

If the tool 18 is to be removed from the tool unit 12, a force is exerted in an anti-clockwise direction upon the latching and unlatching lever 58, whereby the cam-like projection 76 pushes past the elastic sleeve 78 and the latching and unlatching lever 58 can be moved to the position shown in FIGS. 4*a* to 4*c*. The connecting links 70 serve to entrain the spigot 68 and pivot the curve piece 64 in such a manner in an anti-clockwise direction that the extension 72 is pivoted upwards out of the path of the collar 30 and the tool 18 can be removed. This situation as shown in FIGS. 4*a* to 4*c* is defined as the opening position.

The percussion changing device 54 serves to deflect the impacts, which are exerted upon it in the main percussion direction by the percussion piston, in the opposite direction which is also defined as the free percussion direction, so that the impacts can be transmitted by means of the extension 72 to the collar 30 of the tool 18 in the free percussion direction. For this purpose, the percussion changing device 54 comprises inter alia the free percussion ram 38 with the helical compression spring 74, the piston 52, the curve piece 64 and the extension 72.

The percussion changing device 54 also serves to detect the force acting upon the tool which is jammed, if the operator attempts to pull the hammer away. Therefore, the percussion changing device comprises a type of force detection device (the spring 74 in this embodiment), with the aid of which it is possible to introduce a pulling force via the extension 72 into the tool 18 which force simultaneously effects a displacement of the free percussion ram 38 against the helical compression spring 74. The displacement of the free percussion ram 38 is thus proportional to the pulling force generated by the operator.

Furthermore, the percussion changing device 54 comprises a switching device (the ram 38 of this embodiment), as it enables a switch over to the free percussion state by virtue of the corresponding displacement of the free percussion ram 38 to the percussion region of the percussion piston.

Skilled dimensioning of the helical compression spring 74 allows the force detection device to be configured in such a manner that e.g. it is as yet insufficient simply to lift the hammer with the tool from the rock being worked and therefore to exert the weight force of the tool 18 upon the force detection device, in order to effect a switch from the main percussion state to the free percussion state by means of the switching device. In particular, this can be achieved by virtue of the fact that the helical compression spring 74 is prestressed, so that the helical compression spring 74 is not deformed until the pretensioning force representing a threshold value is exceeded. The threshold value should be such that even in the case of heavy tools it is not possible to effect a switch over to the free percussion state by reason of the weight of the tool alone. Only if it is established that the operator has pulled harder on the hammer can a switch be performed.

Essentially, it is also possible in the case of other embodiments of the invention to provide the force detection device, which is to be used to detect the pulling force applied by the operator on the hammer, and the switching device for the purpose of switching between the main percussion state and the free percussion state as separate devices, i.e. in addition to the percussion changing device 54.

The curve piece 64 comprises a specially formed lateral contour 80 which adjoins the extension 72. The contour 80 serves as a sliding surface for the purpose of supporting the end face of the piston 52 which is directed towards the curve piece 64 and the different radial distance of the end face with respect to the axle 66 ensures that the piston 52 and thus also the free percussion ram 58 are axially displaced accordingly. The different positions of the curve piece 64 having the contour 80 and thus of the piston 52 are evident in particular in FIGS. 1*a*, 3*a* and 4*a*.

As shown in particular in FIG. 3*a*, the curve piece 64 is pivoted by the collar 30 about the axle 66 to the extent until parts of the contour 80 lie against the stop 82 which is formed on the housing 12 of the tool unit and represents an inclined surface. This serves to establish a secure end position for the curve piece 64 which also ensures that the extension 72 remains in contact with the collar 30 of the tool 18. As already explained above, the stop 82 also serves to fix the latching and unlatching lever 58 in the position illustrated in FIG. 1*b*.

What is claimed is:

1. A demolition hammer and/or hammer drill for working a material, comprising:

a tool having a tool shaft which is movable over a limited axial path;

a percussion generating device having an axially reciprocatable percussion piston; and a percussion changing device, the percussion changing device including:

a force detection device configured to detect a pulling force which acts upon the tool when the tool is jammed in the material being worked and which is generated by pulling on the demolition hammer and/or hammer drill, and a switching device which is responsive to operation of the force detection device to switch over the percussion piston from a main percussion state to a free percussion state when the force detection device detects that the pulling force exceeds a threshold value, wherein, in the main percussion state the percussion piston influences the tool shaft of the tool directly or via an intermediate element in a main percussion direction, and wherein, in the free percussion state, the percussion piston influences the tool indirectly in a free percussion direction which is opposite to the main percussion direction.

2. A demolition hammer and/or hammer drill as claimed in claim 1, wherein the pulling force effective on the tool is in specific proportion to an axial displacement of the tool relative to the rest of the demolition hammer and/or hammer drill, and that the tool is displaced in the free percussion state with respect to the main percussion state over a distance of the axial path.

3. A demolition hammer and/or hammer drill as claimed in claim 1, wherein a first part of the percussion changing device can be displaced in the free percussion state into an effective region of the percussion piston by means of the tool which can be pulled along the axial path out of the demolition hammer and/or hammer drill.

4. A demolition hammer and/or hammer drill as claimed in claim 3, wherein a second part of the percussion changing device is formed in such a manner that it can be moved into positive-locking contact with a stop provided on the tool, such that a movement of the tool can be transmitted via the second part to the first part of the percussion changing device.

5. A demolition hammer and/or hammer drill as claimed in claim 1, wherein the stop is a collar which widens a cross-section of the tool.

6. A demolition hammer and/or hammer drill as claimed in claim 1, wherein, between the main percussion state and the free percussion state, an idle running state is set for at least a short period of time with the tool in an idle running position.

7. A demolition hammer and/or hammer drill as claimed in claim 1, wherein the percussion piston influences the percussion changing device in the free percussion state in the main percussion direction.

8. A demolition hammer and/or hammer drill for working a material, comprising:

a tool having a tool shaft which is movable over a limited axial path;

a percussion generating device which comprises an axially reciprocatable percussion; and a percussion changing device, including:

a force detection device configured to detect a pulling force which acts upon the tool when the tool is jammed in the material being worked and which is generated by pulling on the demolition hammer and/or hammer drill, and a switching device configured to cooperate with the force detection device for the purpose of switching over from a main percussion state to a free percussion state, wherein, in the main percussion state, the percussion piston influences the tool shaft of the tool directly or via an intermediate element in a main percussion direction, wherein, in the free percussion state, the percussion piston does not influence the tool shaft directly, but rather influences the percussion changing device so as to influence the tool indirectly in a free percussion direction which is opposite to the main percussion direction, wherein it is possible to switch over from the main percussion state to the free percussion state if the tool is jammed in a material being worked, wherein the switch over to the free percussion state is performed if the pulling force exceeds a predetermined threshold value, wherein a first part of the percussion changing device can be displaced in the free percussion state into an effective region of the percussion piston by means of the tool which can be pulled along the axial path out of the demolition hammer and/or hammer drill, wherein, in the main percussion state, a free percussion ram, which forms a first part of the percussion changing device, is removed from an effective region of the percussion piston by an effect of a return spring forming the force detection device, and at the same time, the percussion changing device is pretensioned under the effect of the return spring in such a manner that an extension, that forms a second part of the percussion changing device protrudes into a movement path of a stop which is provided on the tool, and wherein, in the free percussion state, by reason of its changed axial position, the stop of the tool influences the percussion changing device against the effect of the return spring and displaces an impact surface of the free percussion ram into the effective region of the percussion piston when a spring force is overcome.

9. A demolition hammer and/or hammer drill as claimed in claim 8, wherein the percussion piston influences the free percussion ram in the free percussion state in the main percussion direction.

10. A demolition hammer and/or hammer drill as claimed in claim 8, wherein the percussion hammer and/or hammer drill is subdivided into a drive unit and a tool unit which each comprise a housing and can be mutually coupled by mechanically connecting the housings;

wherein a coupling region, which is directed towards the tool unit, of the drive unit is provided with an impact surface of the percussion piston, opposite to which in the coupling region of the tool unit lie the impact surface of the tool shaft and the impact surface of the free percussion ram such that, in the main percussion state, the free percussion ram is removed from the effective region of the percussion piston by means of the return spring and, at the same, is supported under the effect of the return spring on a gear member of the percussion changing device, and which the gear member protrudes with the extension into the movement path of the stop which is provided on the tool; and wherein the stop reaches the extension if, in an idle running state, the tool shaft has been removed from the effective region of the percussion piston so that, as this movement of the tool is continued, the stop influences the gear member against the effect of the return spring and displaces the free percussion ram into the effective region of the percussion piston when the spring force is overcome.

11. A demolition hammer and/or hammer drill as claimed in claim 10, wherein the gear member is a deflecting lever which is mounted on a housing so as to be able to rotate about a first axis.

12. A demolition hammer and/or hammer drill as claimed in claim 10, wherein the gear member is allocated a blocking device which is suitable for limiting the angle of rotation of the gear member between two limit positions such that the extension always protrudes into the path of the stop and the free percussion ram is located in one of the two limit positions in the effective region of the percussion piston and is located in the other of the two limit positions just outside the effective region.

13. A demolition hammer and/or hammer drill as claimed in claim 12, wherein the blocking device is a latching and unlatching lever which is mounted on the housing in such a manner as to be able to rotate about an axle, which is in parallel with an axis of rotation of the gear member and which has a spaced interval therefrom, and said latching and unlatching lever can be fixed via a latch connection in a blocking and latching position in its angular position relative to the housing, and wherein a spigot, which is formed on the gear member, engages into a connecting link which is provided on the latching and unlatching lever and which in the blocking and latching position of said lever limits the angle of rotation of the gear member between the two limit positions, whereas after the latch connection has been overcomes the latching and unlatching lever can be pivoted to an unlatching position in which the connecting link has pivoted the gear member to a position in which the extension is located outside the movement path of the stop provided on the tool.

14. A demolition hammer and/or hammer drill as claimed in claim 13, wherein the latching and unlatching lever consists of two limbs which are axially spaced apart from each other and which are connected at their ends remote from the axle via a cross-piece and which, for mounting in the housing, are provided in each case with an axle stub on their mutually remote outer sides, and that the gear member engages into an intermediate space between the two limbs, whereas its axle is located outside a pivot region of the latching and unlatching lever.

15. A demolition hammer and/or hammer drill as claimed in claim 10, wherein the drive unit and the tool unit are mutually connected in one piece.

16. A demolition hammer and/or hammer drill for working a material, comprising:

a tool having an axially movable tool shaft;

a percussion generating device having an axially reciprocatable percussion piston; and a percussion changing device, the percussion changing device including a force detection device which detects a pulling force which acts upon the tool when the tool is jammed in the material being worked and which is generated by manually pulling on the demolition hammer and/or hammer drill, and a switching device which is responsive to operation of the force detection device to switch over the percussion piston from a main percussion state to a free percussion state when the force detection device detects that the pulling force exceeds a threshold value, wherein, in the main percussion state, the percussion piston at least indirectly drives the tool shaft to move a main percussion direction, and wherein, in the free percussion state, the percussion piston at least indirectly drives the tool shaft to move in a free percussion direction which is opposite to the main percussion direction.

17. A demolition hammer and/or hammer drill as claimed in claim 16, wherein the force detection device comprises a spring.

18. A demolition hammer and/or hammer drill as claimed in claim 17, wherein the spring also functions as a return spring that pretensions the percussion changing device.

19. A demolition hammer and/or hammer drill as claimed in claim 16, wherein the switching device comprises a percussion ram.

* * * * *